US005200731A

United States Patent [19]

Tochio et al.

[11] Patent Number: 5,200,731

[45] Date of Patent: Apr. 6, 1993

[54] DOUBLE INSULATED TRANSFORMER OF THE COAXIAL TYPE AND METHOD OF ASSEMBLING THE SAME

[75] Inventors: Yoshiro Tochio, Tokyo; Yoshihiro Mishimura; Hideo Konishi, both of Nagano, all of Japan

[73] Assignee: Musashino Tuko Co., Ltd., Nagano, Japan

[21] Appl. No.: 575,016

[22] Filed: Aug. 30, 1990

[30] Foreign Application Priority Data

Jan. 26, 1990 [JP] Japan ..... 2-16471

[51] Int. Cl.[5] ..... H01F 27/02; H01F 27/30

[52] U.S. Cl. ..... 336/98; 336/192; 336/198; 361/41

[58] Field of Search ..... 336/90, 98, 192, 198, 336/208; 361/38, 39, 41

[56] References Cited

U.S. PATENT DOCUMENTS

| | | | |
|---|---|---|---|
| 3,213,397 | 10/1965 | Broverman | 336/198 |
| 4,000,483 | 12/1976 | Cook et al. | 336/98 |
| 4,027,279 | 5/1977 | Shigehara | 336/90 |
| 4,234,865 | 11/1980 | Shigehara | 336/192 |

*Primary Examiner*—Thomas J. Kozma
*Attorney, Agent, or Firm*—Fish & Richardson

[57] ABSTRACT

A double-insulated transformer of the coaxial type comprises a core assembly having a center core, a primary winding assembly assembled to surround coaxially the center core which has a primary bobbin case, a primary coil winding wound around the bobbin case and a primary terminal portion provided at an axial end of the bobbin case for connecting the primary coil winding and input lead lines, a secondary winding assembly to surround coaxially the primary winding assembly which has a secondary bobbin case, a secondary coil winding wound around the secondary bobbin case and a secondary terminal portion provided at an axial end of the secondary bobbin case opposite to the primary terminal portion for connecting the secondary coil winding with external lead lines, and an insulating case assembled to surround coaxially the secondary winding assembly. The insulating case comprises a body portion of tube-like shape for covering the secondary coil winding and at least one covering portion formed integrally on an axial end of the body portion and extending along the axial direction for covering one of the primary and secondary termianl portions. By the insulating case provided, the coverage and protection of the secondary coil winding and terminal portions can easily and effectively carried out.

16 Claims, 6 Drawing Sheets

DOUBLE INSULATED TRANSFORMER OF THE COAXIAL TYPE AND METHOD OF ASSEMBLING THE SAME

BACKGROUND OF THE INVENTION

1. Field of the Invention

The present invention relates generally to a transformer of double-insulated type in which a primary and a secondary winding assemblies are assembled to surround coaxially a core assembly in this order. More specifically, the present invention pertains to the double insulated transformer of the above type that has a simplified structure and can easily be assembled.

2. Related Art Description

Among double insulated transformers which meet the Standard of IEC (International Electrotechnical Commission), there has been known a transformer of the type having primary and secondary winding assemblies arranged coaxially in this order around a core assembly, which is referred to as a coaxial-type transformer. In this type of transformer, the primary winding assembly comprises a coil bobbin provided at the center with a through-hole extending axially, into which the center core of the core assembly is inserted. Likewise, the secondary winding assembly comprises a coil bobbin provided at the center with a through-hole extending axially, into which the primary winding assembly is accomodated. The coil bobbins of the primary and secondary winding assemblies have a terminal portion for connecting the outer ends of the coil winding to external lead lines, and both ends of the coil windings and corresponding external lead lines are twisted together and soldered at the respective terminal portions.

In the transformer of the above-mentioned coaxial type, the secondary coil winding of the secondary winding assembly is exposed outwardly, so that it is surrounded by an insulating covering sheet. The terminal portions of the primary and secondary winding assemblies are also exposed, and so covered and protected by another insulating cover in order mainly to prevent operators from accidentally touching the terminals. It is, however, desirable in view of productivity and cost reduction of the transformer that the coverage and protection of those exposed portions can be carried out by utilizing a less number of components and by more simplified assembing operations.

Whereas, in the operations of wiring the coil windings and the external lead lines, both the coil windings and the lead lines are too flexible to remain fixed in their positions by themselves, which causes automatic wiring operation thereof difficult to realize.

SUMMARY OF THE INVENTION

Accordingly, an object of the present invention is to provide a double-insulated transformer of the coaxial type wherein coverage and protection of the secondary coil winding and the terminal portions for external connections can be achieved by means of a simplified structure.

Another object of the present invention is to provide a double-insulated transformer of the coaxial type, to which automatic wiring of the coil windings to the external lead lines can be adopted.

Still another object of the present invention is to provide a method of assembling a double-insulated transformer of the coaxial type wherein components of the transformer can be assembled from the same direction along the axis of the transformer.

In order to accomplish the above and other objects, according to the present invention, a double-insulated transformer of the coaxial type is provided wherein a single insulating member of a novel structure is utilized to cover and protect both a secondary coil winding and an external connecting terminal portion. More specifically, a transformer of the present invention comprises a core assembly having a center core portion which is constituted by an E-shaped core block and an I-shaped core block fixed to the E-shaped core block. A primary winding assembly is arranged to surround the center core portion coaxially which comprises a primary coil bobbin and a primary coil winding surrounding the coil bobbin. The transformer also has a secondary winding assembly which comprises a secondary coil bobbin and a secondary coil winding surrounding the bobbin and which is arranged to surround the primary winding assembly coaxially. The primary and secondary winding assemblies are provided at one end in the axial direction with a primary and a secondary terminal portions for external connection, respectively. The transformer comprises an insulating member of tube-like shape which is assembled so as to surround the secondary coil winding of the secondary winding assembly. The insulating member is provided integrally with at least one covering portion for protecting the primary or secondary terminal portion. In a preferred embodiment of the present invention, the covering portion of the insulating member is provided at its end with a flanged portion extending perpendicularly for covering the primary or secondary terminal portions.

According to the present invention, the tube-like insulating member is assembled to surround the coil winding of the secondary winding assembly, whereby the coil winding is covered in an electrically insulating manner. At the same time, one of the terminal portions is also covered by the flanged covering portion formed integrally on the insulating member. Therefore, the coverage and protection of the secondary coil winding and the terminal portion can be achieved by a single assembling operation of the insulating member.

In one aspect of the present invention, the primary and secondary terminal portions are constituted mainly by a plurality of conductive metallic parts, to which the coil windings and the corresponding external lead lines are connected. The metallic parts have rigidity sufficient to keep them in positions and in place. The metallic parts may be of a pin-shape. According to this structure, the coil windings and the corresponding external lead lines are connected on the metallic parts of the terminal portions standing at the fixed positions, so that the wiring operations between them can easily be carried out by means of an automatic wiring process.

In another aspect of the present invention, there is provided a method of assembling a double-insulated transformer of the coaxial type which includes a core assembly, a primary and secondary winding assemblies, and an insulating member of tube-like shape. The core assembly comprises an E-shaped core block constituted by stacking integrally a plurality of E-shaped core elements and an I-shaped core block constituted by stacking integrally a plurality of I-shaped core elements. The insulating member of tube-like shape is formed integrally at both ends with cover portions for covering the terminal portions of the primary and secondary winding assemblies, and is preferably with a flanged portion extending perpendicularly from the end of the secondary cover portion. The transformer having the insulating member of the present invention is assembled by the following steps. At first, the E-shaped core block is installed on a horizontal surface such as of a circuit board in a manner that the three legs of the core block are extending upwardly. The insulating member is then inserted into the E-shaped core block from the upward direction with the primary cover portion and the associated flanged portion facing downwardly. The primary winding assembly is inserted into the assembled insulating member from the side of the primary terminal portion along the axis of the insulating member. Next, the secondary winding assembly is inserted between the insulating member and the primary winding assembly in a manner that the secondary terminal portion faces upwardly. Finally, the I-shaped block is placed on the upper ends of the legs of the E-shaped core block and fixed thereto. Thus, the components of the transformer are assembled from the same direction along the axis of the transformer, which makes it easy, for example, to apply automatic assembly operation to that of the transformer.

PREFERRED EMBODIMENTS OF THE INVENTION

While the present invention will be described in connection with the preferred embodiments, it will be understood that the present invention is not limited to these embodiments. On the contrary, it is intended to cover all alternatives, modifications, and equivalents as may be included within the spirit and scope of the invention as defined by the attached claims.

Figure 1:
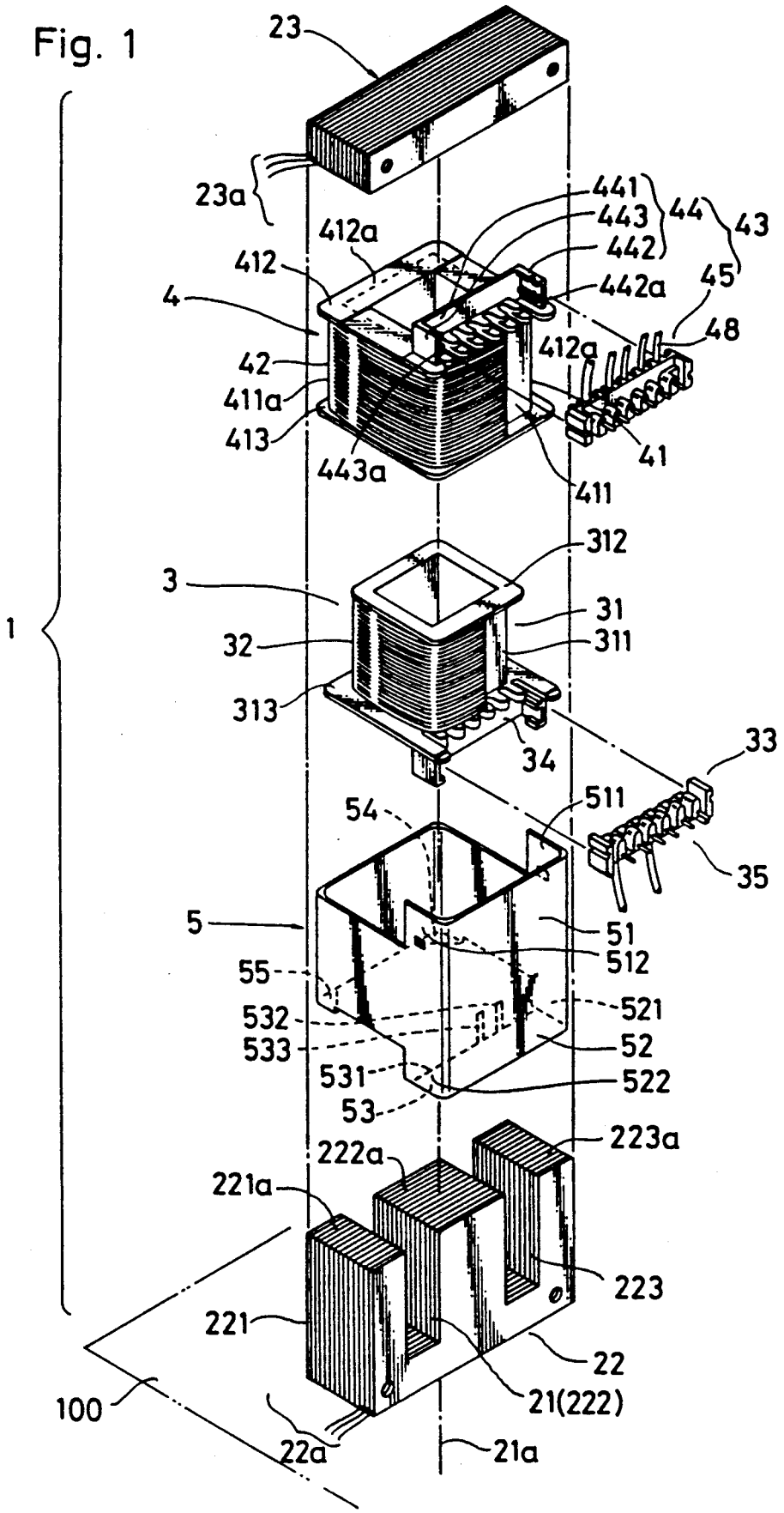
FIG. 1 is an exploded perspective view of an example of a transformer according to the present invention.
Figure 2:
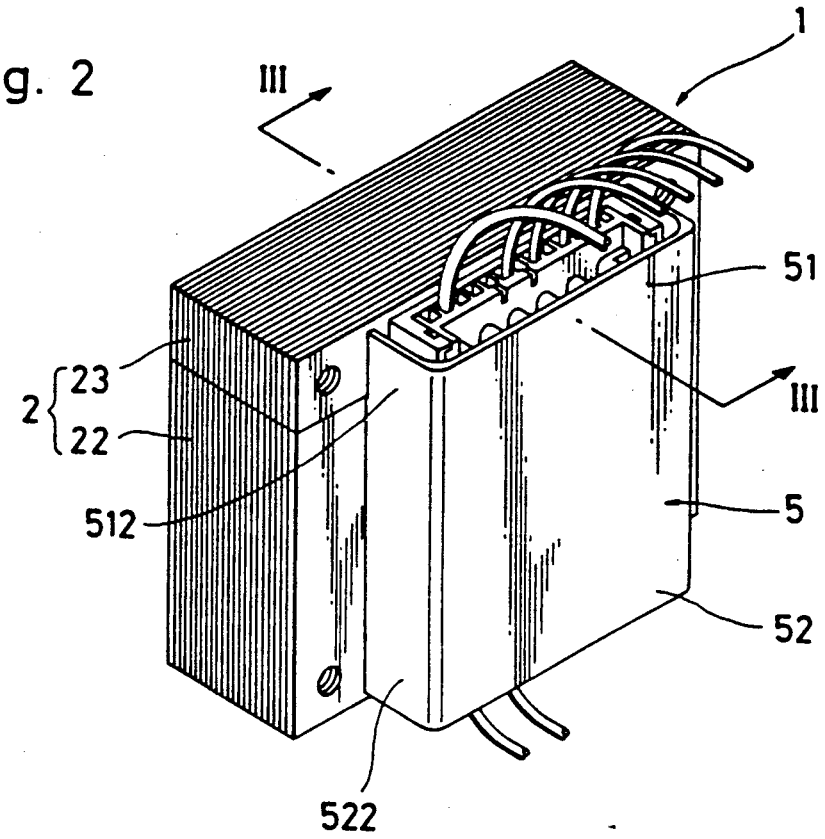
FIG. 2 is a perspective view of the assembled condition of the transformer of FIG. 1.

Referring now to the drawings, FIGS. 1 and 2 illustrate exploded and perspective views of a double-insulated transformer of the coaxial type in accordance with the present invention. As shown in these Figures, the transformer 1 comprises a core assembly 2 having a center core 21, a primary winding assembly 3 assembled coaxially to surround the center core 21, a secondary winding assembly 4 surrounding coaxially the primary winding assembly 3, and an insulating case 5 surrounding coaxially the secondary winding assembly 4.

The core assembly 2 is comprised by an E-shaped core block 22 and an I-shaped core block 23 fixed to the upwardly facing ends of the E-shaped core block 22. The E-shaped core block 22 is constituted by a plurality of E-shaped flat elements 22*a* stacked integrally, whereas the I-shaped core block 23 by a plurality of I-shaped flat elements 23*a* (or rectangular strap elements) stacked integrally. The E-shaped core block has three legs 221, 222, 223 projecting upwardly in parallel to each other, the middle leg 222 of which functions as the center core 21. The I-shaped core block 23 is placed on and fixed to the upwardly facing ends 221*a*–223*a* of these legs 221–223, so that the core assembly 2 of closed type is composed. Around the center core 21, the primary and secondary assemblies 3, 4 and the insulating case 5 are mounted coaxially in this order from the center core 21 such that they are enclosed by the closed-type core assembly 2.

Figure 3:
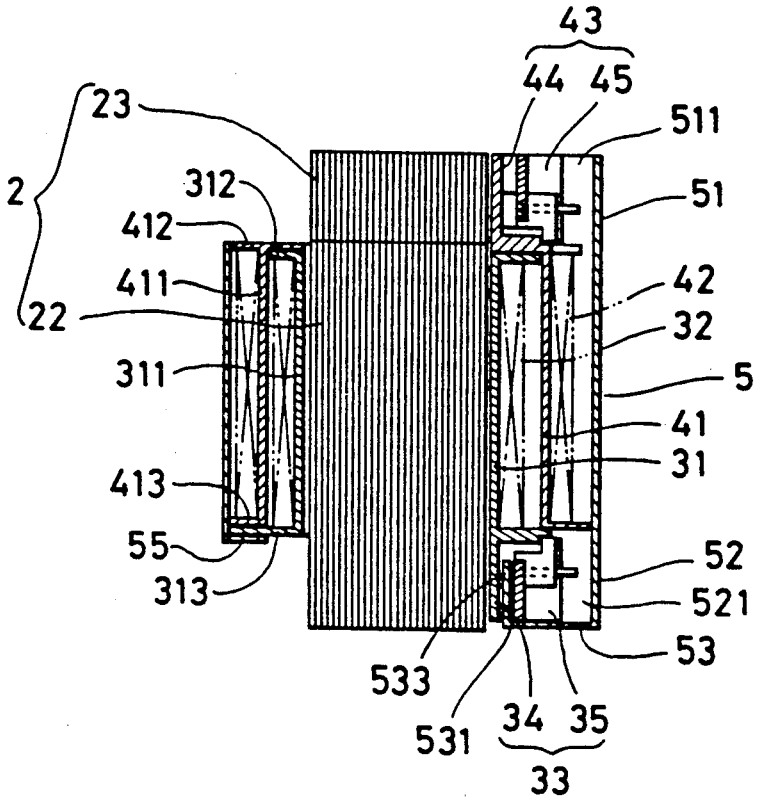
FIG. 3 is a cross-sectional view of the transformer of FIG. 2 taken along line III—III.

As can be seen in FIGS. 1 and 3, the primary winding assembly 3 comprises a coil bobbin 31, a coil winding 32 wound around the coil bobbin 31, and a terminal portion 33 for external connection formed on the lower end of the coil bobbin 31. The coil bobbin 31 is formed by synthetic resin to have a tube-like body 311 into which the center core 21 can be fitted and flanges 312, 313 formed on the upper and lower ends of the body 31. The coil bobbin 31 is of the axial length a little bit shorter than that of the center core 21. The lower flange 313 is provided at one side with the terminal portion 33 which is comprised by a receiving portion 34 integrally formed on the flange 313 and a connecting portion 35 attached removablly to the receiving portion 34. The terminal portion 33 will be explained in detail later.

The secondary winding assembly 4 is of an almost the similar structure to that of the primary winding assembly 3. The secondary winding assembly 4 comprises a coil bobbin 41, a secondary coil winding 42 wound around the coil bobbin 41, a terminal portion 43 for external connection. The coil bobbin is made by synthetic resin and has a rectangular, tube-like body 411, into which the primary winding assembly 3 except for its lower flange 313 and the terminal portion 33 is to be inserted. The tube-like body 411 is formed integrally at its upper and lower ends with upper and lower flanges 412, 413, respectively. The sizes and shapes of the tube-like body 411, the upper and lower flanges 412, 413 are set such that, in an assembled condition, the lower flange 413 is seated on the lower flange 313 of the primary winding assembly 3, whereas the upper flange 412 is seated at its inwardly extending portion 412*a* on the upper flange 312. The upper flange 412 of the body 411 is provided at the same side of the primary terminal portion 33 with the secondary terminal portion 43 for external connection which is comprised by a receiving portion 44 integrally formed on the upper flange 412 and a connecting portion 45 removably attached to the receiving portion 44.

The insulating case 5 is of a tube-like shape formed by synthetic resin and has a cross-sectional size to enable receiving the secondary winding assembly 4. The upper end of the insulating case 5 extends upwardly along the axial direction at the side the secondary terminal portion 43 is located, to thereby form a secondary covering portion 51 for covering the lateral side of the secondary terminal portion 43. The secondary covering portion 51 extends at both ends perpendicularly to form side covering portions 511 and 512. Likewise, the lower end of the insulating case 5 extends downwardly along the axial direction at the side the primary terminal portion 33 is formed, to form a primary covering portion 52 for covering the lateral side of the primary terminal portion 33. Both ends of the primary covering portion 52 extend perpendicularly to form side covering portions 521 and 522. In addition, the lower end of the primary covering portion 52 facing downwardly extends inwardly and perpendicularly to the axial direction to form an integrated flange portion 53. In an assembled condition, this flange portion 53 is located beneath the primary terminal portion 33 and covers the lower side thereof. The inward end 531 of the flange portion 53 is formed integrally with two inserting pins 532, 533 extending upwardly along the axial direction. The function of these pins will be explained later. Trianglular pieces 54 and 55 are formed integrally at the lower end corners of the case 5 located opposite to the covering portion 52. The pieces 54, 55 are reinforcement members for the case 5, on which the lower flange 413 of the secondary winding assembly 4 is seated of its corresponding corner portions when assembled.

Next, the primary and secondary terminal portions 33, 43 provided in the primary and secondary winding assemblies will be explained in detail. As shown in FIG. 1, the secondary terminal portion 43 comprises the receiving portion 44 at the bobbin side and the connecting portion 45 removably attached to the receiving portion 44. The receiving portion 44 is constituted by a side wall 441 extending upwardly along the bobbin axis and end walls 442 and 443 formed integrally at the ends of the side wall 441.

Figure 4C:
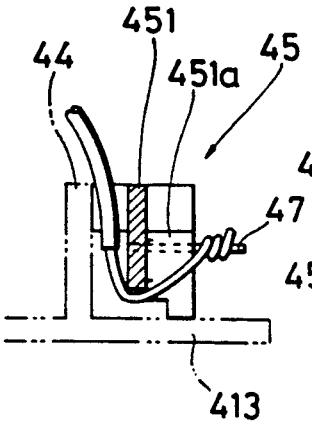
FIG. 4C is a cross-sectional view of the terminal portion of FIG. 4A taken along line C—C.
Figure 4A:
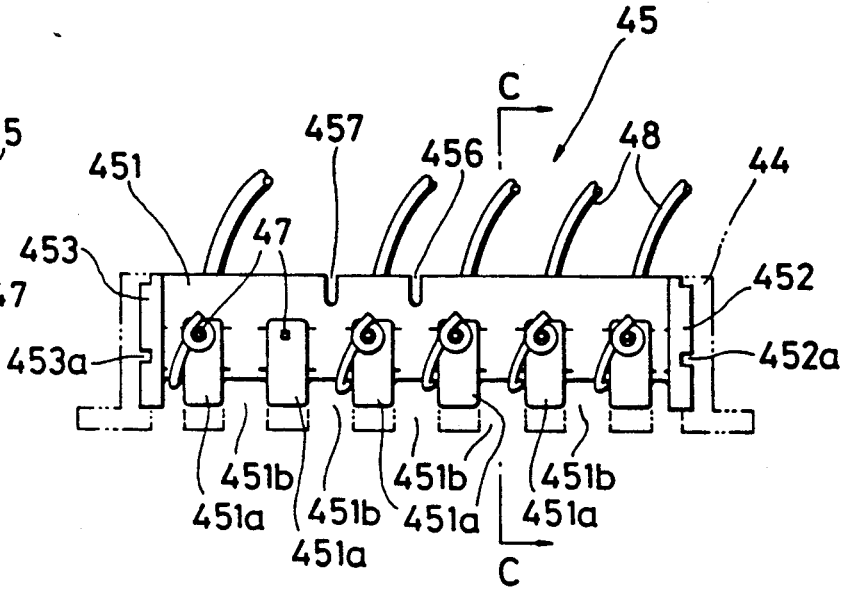
FIG. 4A is a front view of the secondary terminal portion of the secondary winding assembly in FIG. 1.
Figure 4B:
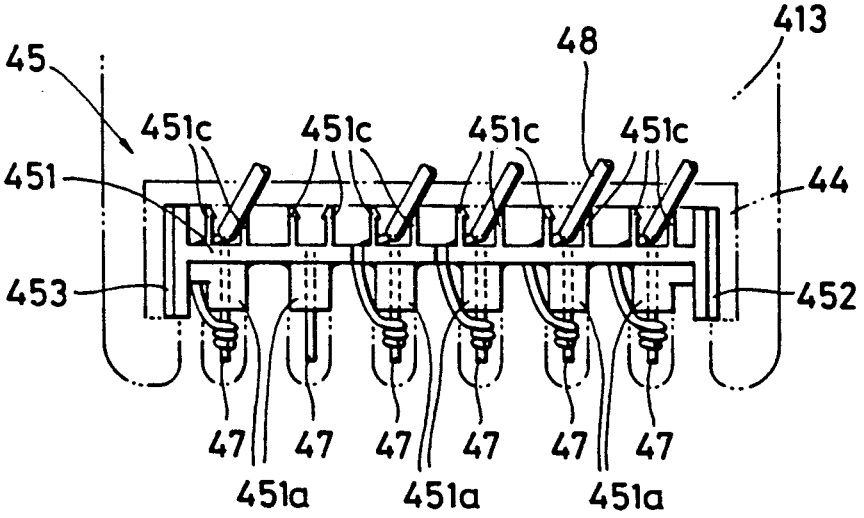
FIG. 4B is a plan view of the terminal portion of FIG. 4A.

The upper flange portion 412 surrounded by these walls is formed with a plurality of cutouts 412*a* at equal intervals, through which the outer ends of the secondary coil winding 42 are pulled up to the connecting portion 45. FIGS. 4A–4C illustrate the connecting portion 45 which is mainly comprised by a side wall 451 and end walls 452 and 453 integrally formed on the ends of the side wall 451. The end walls 452 and 453 are formed at their outer side surfaces with grooves 452*a* and 453*a* extending laterally, into which lateral projections 442*a* and 443*a* formed on the inner side surfaces of the end walls 442 and 443 of the receiving portion 44, are fitted, respectively. On the surface of the side wall 451 facing laterally and outwardly, a plurality of projections 451*a* are formed extending laterally and outwardly, each of which has a connecting pin 47 of rectangular cross section penetrated therethrough. Each of the connecting pins 47 projects from the tip of the corresponding projection 451*a* by a prescribed length. On the lower end of the side wall 451, arcuate cutouts 451*b* are formed such that each of them locates between the adjacent projections 451*a*. The side wall 451 is formed at rear side surface with a plurality of pairs of projections 451*c*, each pair of projections being located in response to each of the arcuate cutouts 451*b*. Each pair of projections 451*c* is utilized for fixing one of external lead lines between them.

In the above-constituted terminal portion 43, the outer lead lines 48 are arranged and fixed between the respective pair of the projections 451*c*, and the exposed ends of the lead lines are passed through the arcuate cutouts 451*b* to reach the front side of the side wall 451 and are then twisted around the projected tips of the pins 47. While, the outer ends of the secondary coil winding 42 are also pulled up to the pins 47 and twisted around the tips of the pins. The lead lines and the outer ends of the secondary coil winding, which are twisted around the pins, are then soldered to fix the pins.

Figure 5A:
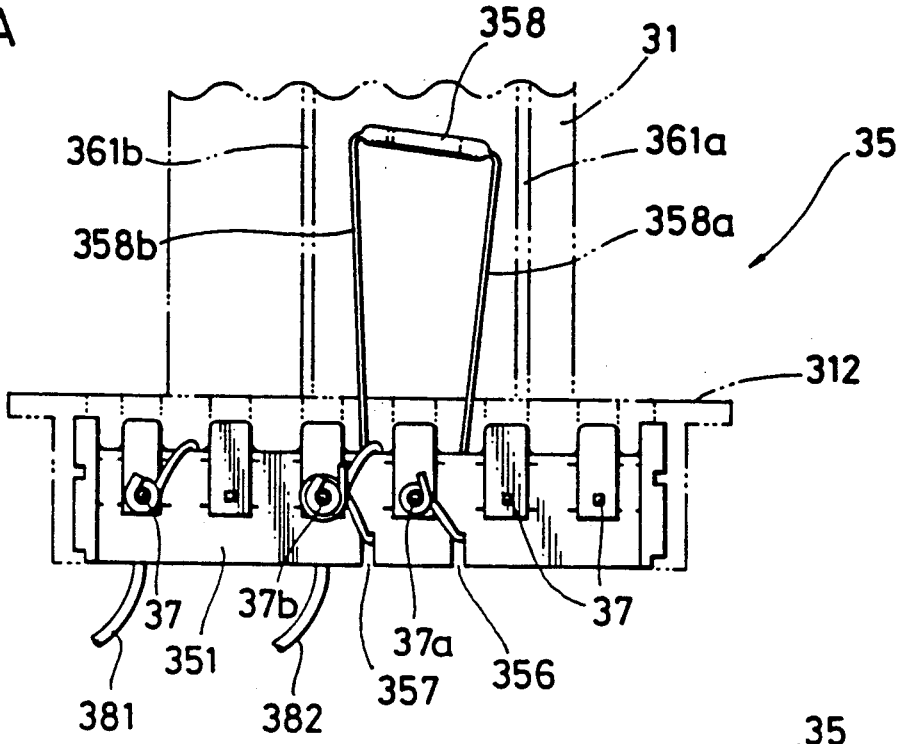
FIG. 5A is a front view of the primary terminal portion of the primary winding assembly in FIG. 1.
Figure 5B:
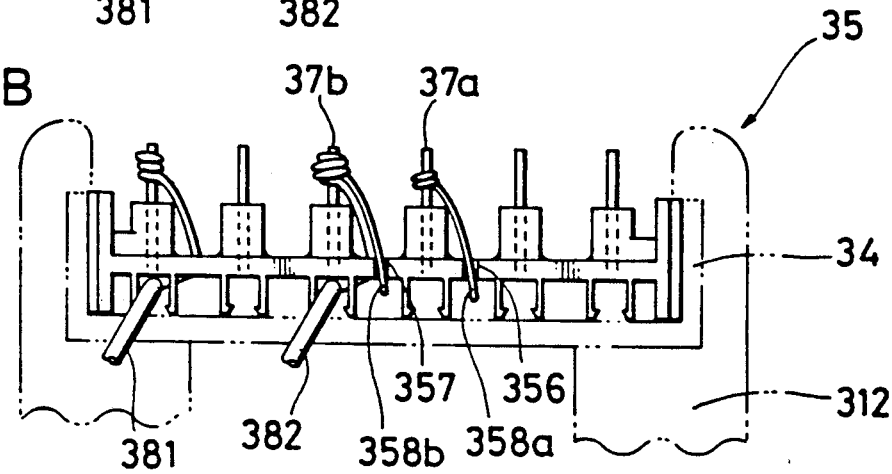
FIG. 5B is a bottom view of the primary terminal portion of the primary winding assembly of FIG. 5A.
Figure 5C:
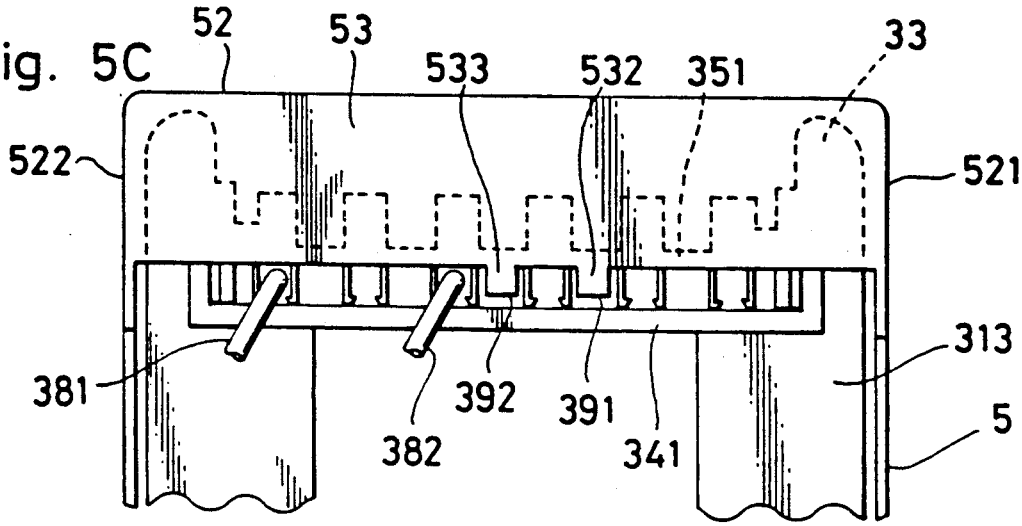
FIG. 5C is a partial bottom view of the transformer of FIG. 1, illustrating the primary terminal portion covered by the flanged portion.
Figure 5D:
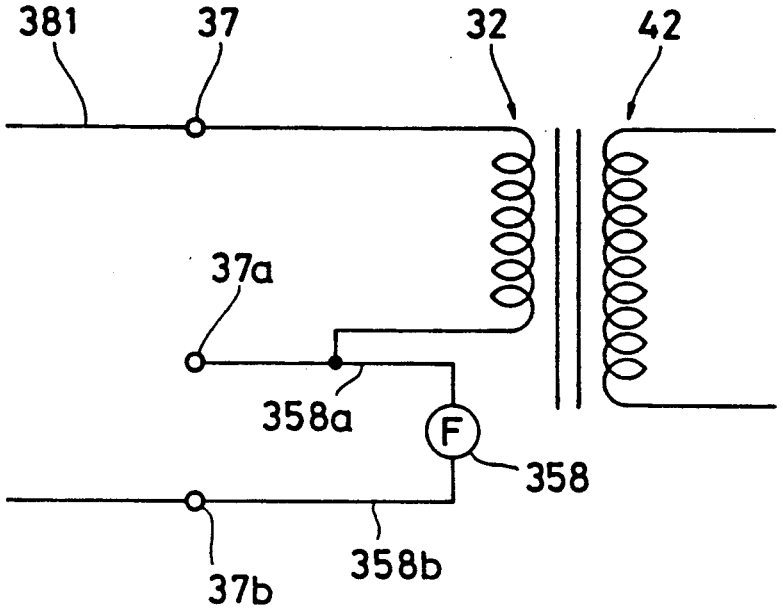
FIG. 5D illustrates an electrical connection of the fuse and the primary coil winding in the transformer of FIG. 1.

The primary terminal portion 33 is of substantially the same structure as that of the secondary terminal portion 43. The primary terminal portion 33 is provided on the lower flange 313 such that it is upside down with reference to the secondary terminal portion 43. As shown in FIGS. 5A–5C, the side wall 351 of the connecting portion 35 is formed at lower end facing downwardly with two cutouts 356, 357 extending upwardly, through which both legs 358*a*, 358*b* of a fuse 358 are arranged to pass from the rear side of the wall 351 to the front side thereof, and twisted and soldered to the tips of the pins 37*a*, 37*b*. The one of input lead lines 382 of the primary coil winding 32 is fixed to the one of the above two pins. The other input lead line 381 is fixed to another pin. The fuse 358 is accomodated in a gap formed by the longitudinally extending projections 361*a*, 361*b* of the peripheral surface of the coil bobbin 31 between the peripheral surface of the coil bobbin 31 and the secondary coil winding 32 around the coil bobbin (see FIG. 1). The fuse 358 is provided to prevent the transformer from inducing excessive electrical current. An electrical connection of the fuse 358 and the primary coil winding 32 is illustrated in FIG. 5D.

As shown in FIG. 5C, in an assembled condition, the primary terminal portion 33 is covered at its lower side with the flange portion 53 to the extent of the side wall 341, and so the input lead lines 381, 382 can be arranged to connect the pins 37 through the openings defined between the side walls 341 and 351. However, the two openings 391 and 392, through which the legs of the fuse 358 are arranged, are shielded by the inserting pins 532, 533 in such a manner that these pins are fitted into these openings, respectively. Thus, the legs of the fuse are not accessible from the outside.

In the present embodiment, the primary and the secondary terminal portions are of the same structure in order that the connecting portion can be commonly used for the primary and secondary terminals. Therefore, the connecting portion 45 of the secondary terminal 43 is also provided with the cutouts 456, and 457 on the upper end of the side wall 431 as shown in FIG. 4A.

The assembling process of the transformer will now be explained with reference mainly to FIG. 1. Each component of the transformer is prepared beforehand. The primary and secondary winding assemblies 3 and 4 are prepared such that the outer lead lines and the coil windings are connected to the corresponding pins 37 and 47 by soldering. Firstly, the E-shaped core block 22 is placed on a horizontal plane 100 such as of a circuit board in a manner that the three legs 221–223 are facing upwardly. The insulating case 5 oriented to make the primary covering portion 52 to face downwardly is then mounted to surround coaxially the center core 21 (that is the middle leg 222) from the upward direction along the axis 21*a*. Subsequently, the primary winding assembly 3 with its terminal portion 33 facing downwardly is inserted between the core block 21 and the mounted insulating case 5 from the same direction, so that the primary terminal portion 33 comes into the condition covered at its lateral and lower sides by the primary covering portion 52 of the insulating case 5, wherein the inserting pins 532, 533 are inserted into the two openings 391, 392, the legs of the fuse are arranged therein, to thereby shield them. Then, the secondary winding assembly 4, with the terminal portion 43 facing upwardly, is inserted between the mounted insulating case 5 and primary winding assembly 3 from the above along the axis 21*a*, whereby the coil winding 42 and terminal portion 43 become in the condition that they are covered by the insulating case 5 and its upper covering portion 51, respectively. Finally, the I-shaped core block 23 is mounted on the legs 221–223*a* of the E-shaped core block 22 and fixed thereto by a suitable means such as welding or the like. Thus, the assembled transformer as shown in FIG. 2 is obtained by assembling its components from the same direction.

Figure 6:
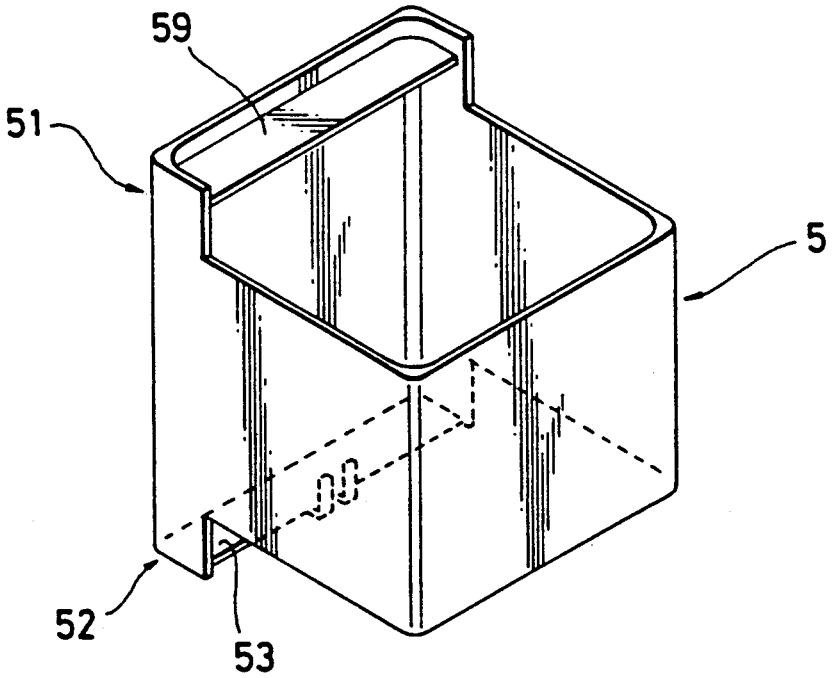
FIG. 6 is a perspective view of another example of the insulating case shown in FIG. 1.

FIG. 6 illustrates a modified example of the insulating case 5, wherein the secondary covering portion 51 is also provided with a flange portion 59 for covering the upper end of the secondary terminal portion. The flange portion 59 is of an insulating flat panel which is removably attached to the secondary covering portion 51. In assembling, the flange portion 59 is attached to the secondary covering portion 51 after the secondary winding assembly 4 is mounted.

Figure 7:
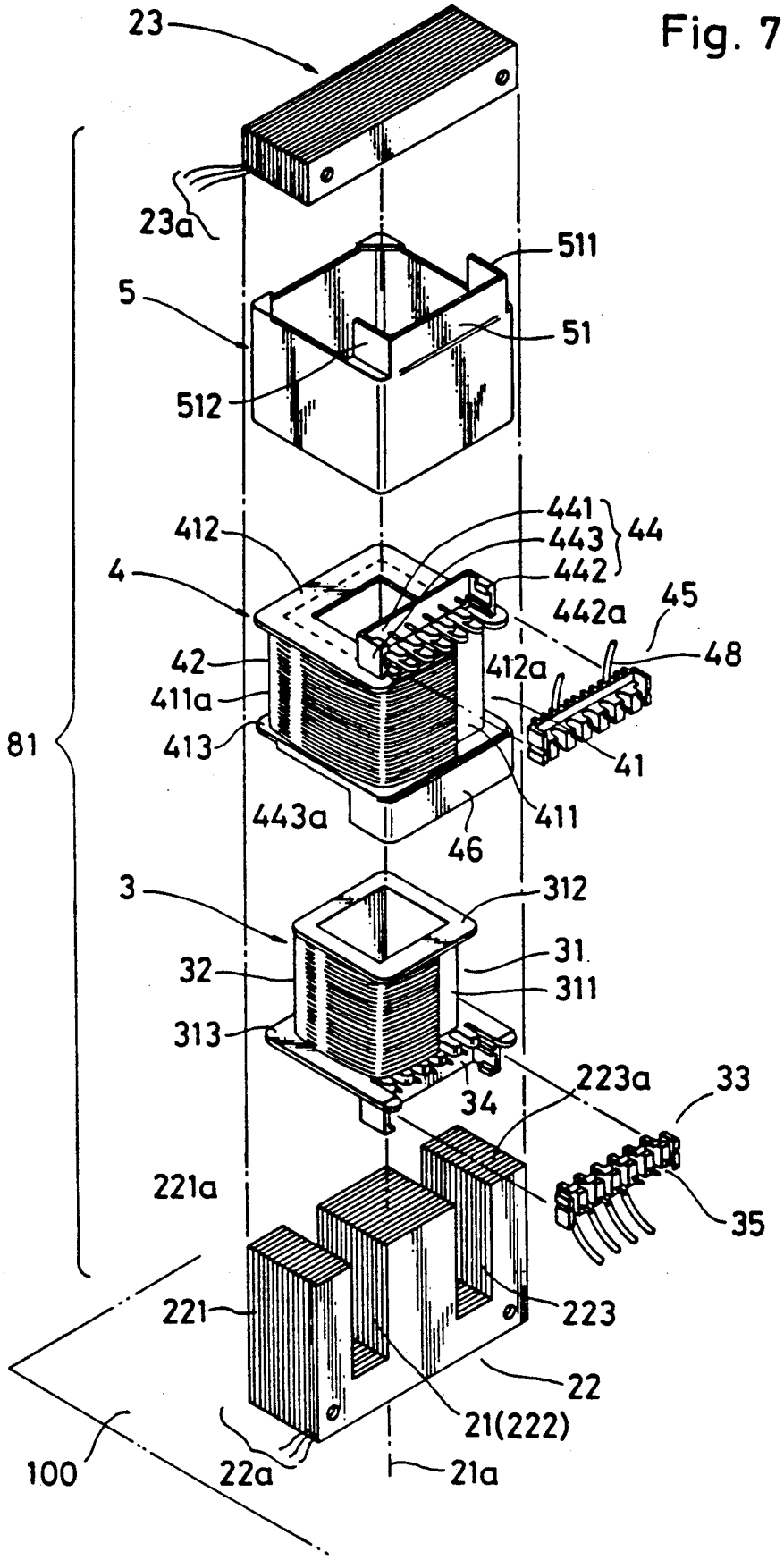
FIG. 7 is a exploded view of another transformer according to the present invention.

Next, FIG. 7 illustrates another embodiment of a transformer of the present invention. The transformer 81 is of substantially the same structure as that of FIG. 1, and so corresponding elements of the transformer 81 are denoted by the same reference numerals as in FIG. 1. The transformer of this embodiment has an insulating case 5 formed only with a secondary covering portion 51, while a secondary winding assembly 4 has a primary covering portion 46 formed integrally on the lower end of the coil bobbin 41. In assembling, after the primary winding assembly 3 has been mounted on the E-shaped core block 22, the secondary winding assembly 4 is mounted to surround coaxially the primary winding assembly 3. After that, the insulating case 5 is mounted to surround the assembled secondary winding assembly 4. Finally, the I-shaped core block 23 is fixed to the upper ends of the E-shaped core block 22. According to this embodiment, the assembly operation of the transformer can be carried out from the same direction along the axis of the transformer. In addition, by assembling the insulating case 5, the coverage of the secondary coil winding 42 and the secondary terminal portion 43 can be performed at the same time.

We claim:

1. A double-insulated transformer of the coaxial type, comprising a core assembly having a center core; a primary winding assembly assembled to surround coaxially the center core of said core assembly which has a primary bobbin case, a primary coil winding wound around the bobbin case and a primary terminal portion provided at an axial end of said bobbin case for connecting the primary coil and input lead lines; a secondary winding assembly assembled to surround coaxially said primary winding assembly which has a primary bobbin case, a secondary coil winding wound around said secondary bobbin case and a secondary terminal portion provided at an axial end of said secondary bobbin case opposite to said primary terminal portion for connecting said secondary coil winding with external lead lines; and an insulating case assembled to surround coaxially said secondary winding assembly, wherein said insulating case comprises a body portion of tube-like shape for covering said secondary coil winding and at least one covering portion formed integrally on an axial end of said body portion and extending along the axial direction for covering one of said primary and secondary terminal portions.

2. A transformer of the coaxial type as set forth in claim 1, wherein said insulating case is formed at both axial ends with a primary and a secondary covering portions, said primary covering portion being located at the same axial end said primary terminal portion is provided so that it covers a lateral outside of said primary terminal portion, and said secondary covering portion being located at the opposite axial end to cover a lateral outside of said secondary terminal portion.

3. A transformer of the coaxial type as set forth in claim 2, wherein said primary covering portion of said insulating case is provided with a flange portion extending inwardly perpendicular to said primary covering portion for covering the axial end of said primary terminal portion.

4. A transformer of the coaxial type as set forth in claim 3, wherein said flange portion is formed with two insulating projections extending axially toward the opposite axial side by a prescribed length and wherein said projections shield openings of said primary terminal portion through which connecting lines of a fuse element for preventing the transformer from being applied with excessive electrical current are arranged, whereby said connecting lines of said fuse element is not accessible from the outside.

5. A transformer of the coaxial type as set forth in claim 1, wherein said primary and secondary terminal portions are provided with a plurality of conductive metallic parts for fixing the connecting positions to be in place between said lead lines and said coil windings.

6. A transformer of the coaxial type as set forth in claim 1, wherein said core assembly comprises an E-shaped core block made from a plurality of E-shaped flat elements and an I-shaped core block made from a plurality of I-shaped flat elements, said I-shaped core block being fixed on the three legs of said E-shaped core block to form a closed-type core assembly having the middle leg of said E-shaped core block functioning as said center core.

7. A transformer of the coaxial type as set forth in claim 6, wherein said insulating case is formed at both axial ends with a primary and a secondary covering portions, said primary covering portion being located at the same axial end said primary terminal portion is provided so that it covers a lateral portion outside of said primary terminal portion, and said secondary covering portion being located at the opposite axial end to cover a lateral outside of said secondary terminal portion.

8. A transformer of the coaxial type as set forth in claim 7, wherein said primary covering portion of said insulating case is provided with a flange portion extending inwardly perpendicular to said primary covering portion for covering the axial end of said primary terminal portion.

9. A transformer of the coaxial type as set forth in claim 8, wherein said flange portion is formed with two insulating projections extending axially toward the opposite axial side by a prescribed length and wherein said projections shield openings of said primary terminal portion through which connecting lines of a fuse element for preventing the transformer from being applied with excessive electrical current are arranged, whereby said connecting lines of said fuse element are not accessible from the outside.

10. A transformer of the coaxial type as set forth in claim 9, wherein said primary and secondary terminal portions are provided with a plurality of conductive metallic parts for fixing the connecting portions in place between said lead lines and said coil windings.

11. A double-insulated transformer of the coaxial type, comprising a core assembly having a center core; a primary winding assembly assembled to surround coaxially the center core of said core assembly which has a primary bobbin case, a primary coil winding wound around the bobbin case and a primary terminal portion provided at an axial end of said bobbin case for connecting the primary coil and input lead lines; a secondary winding assembly assembled to surround coaxially said primary winding assembly which has a secondary bobbin case, a secondary coil winding wound around said secondary bobbin case and a secondary terminal portion provided at an axial end of said secondary bobbin case opposite to said primary terminal portion for connecting said secondary coil winding with external lead lines; and an insulating case assembled to surround coaxially said secondary winding assembly, wherein said insulating case comprises a body portion of tube-like shape for covering said secondary coil winding and a secondary covering portion formed integrally on an axial end of said body portion and extending along the axial direction for covering said secondary terminal portion, and wherein said secondary bobbin case of said secondary winding assembly is formed on its axial end with a primary covering portion for covering said primary terminal portion.

12. A transformer of the coaxial type as set forth in claim 11, wherein said secondary covering portion of said insulating case is provided with a flange portion extending inwardly perpendicular to said secondary covering portion for covering the axial end of said secondary terminal portion.

13. A transformer of the coaxial type as set forth in claim 12, wherein said primary and secondary terminal portions are provided with a plurality of conductive metallic parts for fixing the connecting portions in place between said lead lines and said coil windings.

14. A transformer of the coaxial type as set forth in claim 11, wherein said core assembly comprises an E-shaped core block made from a plurality of E-shaped flat elements and an I-shaped core block made from a plurality of I-shaped flat elements, said I-shaped core block being fixed on the three legs of said E-shaped core block to form a closed-type core assembly having the middle leg of said E-shaped core block as said center core.

15. A transformer of the coaxial type as set forth in claim 14, wherein said secondary covering portion of said insulating case is provided with a flange portion extending inwardly perpendicular to said secondary covering portion for covering the axial end of said secondary terminal portion.

16. A transformer of the coaxial type as set forth in claim 15, wherein said primary and secondary terminal portions are provided with a plurality of conductive metallic parts for fixing the connecting portions in place between said lead lines and said coil windings.

* * * * *